United States Patent [19]

Workman et al.

[11] Patent Number: 4,749,088

[45] Date of Patent: Jun. 7, 1988

[54] DOLL POLE

[75] Inventors: Janice C. Workman, 14384 Meranda Rd., Anna, Ohio 45302; Russell W. Morris, Ashland, Ohio

[73] Assignee: Janice C. Workman, Anna, Ohio

[21] Appl. No.: 20,795

[22] Filed: Mar. 2, 1987

[51] Int. Cl.[4] ..... A47B 47/06

[52] U.S. Cl. ..... 211/13; 211/113; 211/118; 403/223; 403/291

[58] Field of Search ..... 211/113, 13, 118, 195, 211/116, 115, 125; 206/806; 403/223, 291, 229; 248/339

[56] References Cited

U.S. PATENT DOCUMENTS

| | | | |
|---|---|---|---|
| P. 237,287 | 10/1975 | Crawford . | |
| P. 237,288 | 10/1975 | Crawford . | |
| 1,172,937 | 2/1916 | Butcher | 211/113 |
| 1,574,192 | 2/1926 | Gutterman | 211/13 X |
| 2,593,218 | 4/1952 | Swain . | |
| 2,953,828 | 9/1960 | Hochman | 211/113 X |
| 3,308,959 | 3/1967 | Repair | 211/13 |
| 3,709,373 | 1/1973 | Aguilar | 211/113 |
| 3,876,080 | 4/1975 | Hultberg et al. . | |
| 4,206,567 | 6/1980 | Cieslak . | |
| 4,208,037 | 6/1980 | Le Gal | 403/223 X |
| 4,435,915 | 3/1984 | Zaruba et al. . | |

FOREIGN PATENT DOCUMENTS

| | | | |
|---|---|---|---|
| 1354086 | 1/1964 | France | 211/13 |
| 227004 | 1/1925 | United Kingdom | 211/113 |

OTHER PUBLICATIONS

Taylor Gifts Advertisement of Unknown Date, p. 66, Address: Taylor Gifts, 355 E. Conestoga Rd., P.O. Box 206, Wayne, PA 19087.

Advertisement Bearing 1987 Copyright by Starcrest of California, 19465 Brennan Ave., Perris, California 92379.

*Primary Examiner*—Ramon S. Britts
*Assistant Examiner*—Karen J. Chotkowski
*Attorney, Agent, or Firm*—Dybvig & Dybvig

[57] ABSTRACT

A doll pole for suspending stuffed dolls has a pair of stiffening and filler rods made from resilient foam plastic that are coaxially aligned and housed in a hollow tube made from sheet material. The rods are slidable within the tube and have a combined length which is less than the length of the tube so that the tube may be folded at its midsection for ease of transport and storage. Ribbons are spaced along the length of the tube for tying the stuffed dolls to the pole.

24 Claims, 3 Drawing Sheets

DOLL POLE

SUMMARY OF THE INVENTION

This invention relates to a doll pole for hanging, storing and displaying dolls. A doll pole is an elongate pole adapted to be suspended from a ceiling or wall that is provided with means at various locations along its length for suspending dolls, in particular stuffed animal dolls and the like.

Doll poles can be highly efficient and attractive devices for organizing bedrooms, dens or playrooms. To be genuinely useful, they should be attractive, lightweight, rugged, inexpensive, easy to assemble, and easy to transport and store, and it is an object of this invention to provide such a doll pole. Because intended for use in children's bedrooms or play areas where active play is to be expected, the poles should also be soft and resilient to avoid injury to person or property.

Known prior doll poles have comprised either elongate, solid pieces of wood, or elongate, stuffed fabric tubes. A doll pole desirably should be about six feet long. If made as a unitary device needing no assembly, a doll pole poses a problem because it is cumbersome to transport, whether by hand or by package delivery, and store. A more specific object of this invention is to provide an improved, unitary doll pole that may be bent or folded at its midsection so that it is less cumbersome to transport and store, can be readily straightened out, requires no assembly, and will hang straight when suspended.

In accordance with this invention, a doll pole is provided having an elongate, hollow tube formed from flexible sheet material, for example, a woven fabric such as a cotton and polyester blend, means covering the bottom end of the tube, means connected to the upper end of the tube for suspending it from a wall or ceiling, and holding means spaced along the length of the tube for removably suspending stuffed animal dolls or the like from the tube. Stiffening and filler means within and substantially filling the tube cause the tube to have an elongate, pole-like shape and maintain such shape during use. The stiffening and filler means comprises a pair of substantially identical rods slidably mounted within the tube and coaxially aligned therein. The rods have a combined length sufficiently less than the length of the tube that the tube may be folded through substantially 180 degrees at its midsection for storage and shipment. In the preferred practice of the invention, the stiffening and filler rods comprise a resilient foam plastic.

Other objects and advantages will become apparent from the following description and the claims.

BRIEF DESCRIPTION OF THE DRAWINGS

FIG. 7 is on the same scale as FIG. 6 whereas FIG. 8 is on a smaller scale than FIG. 6.

DETAILED DESCRIPTION

Figure 1:
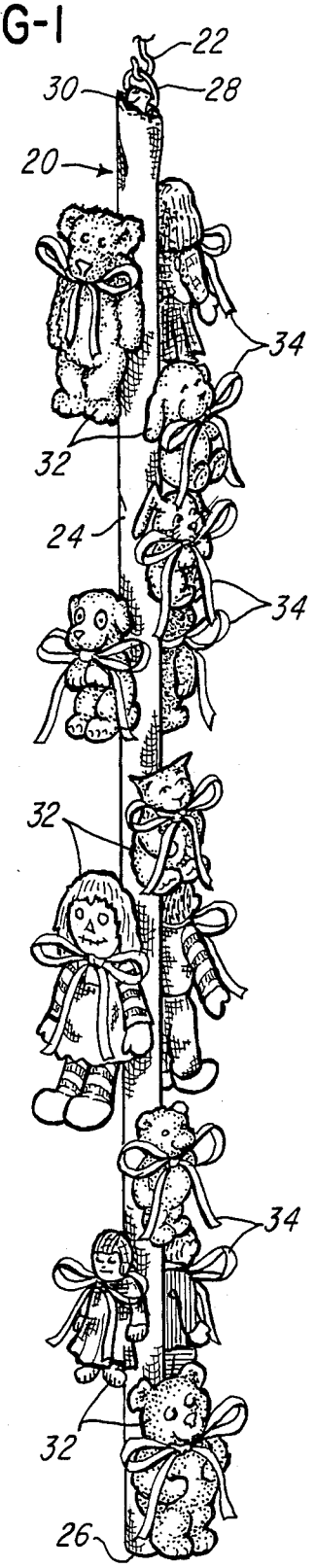
FIG. 1 is a perspective view of a doll pole in accordance with this invention, a hanger for use therewith, and stuffed dolls suspended therefrom.

With reference to FIG. 1, a doll pole in accordance with this invention, generally designated 20, is adapted to be suspended from a wall or ceiling by a suitable hanger, as indicated by hook 22. Although exact dimensions are not critical, a pole 20 in accordance with this invention would typically be on the order of six feet long and one and one-half inches in diameter. For reasons discussed below, the pole has a presently preferred length of approximately six and one-half feet.

Figure 2:
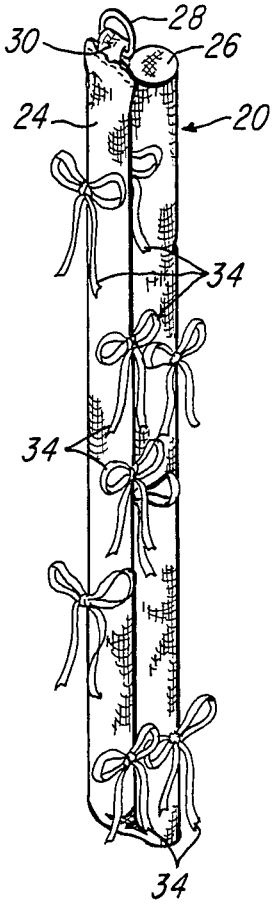
FIG. 2 is a perspective view of the pole of FIG. 1 shown folded at its midsection for convenience in shipping, carrying or storage.
Figure 3:
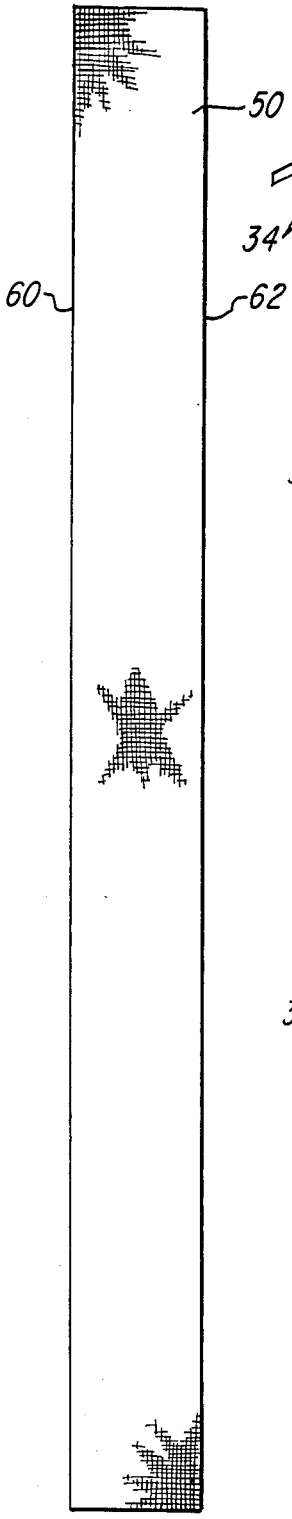
FIG. 3 is a plan view of a part used to produce the pole of FIG. 1.

For convenient transport and storage, the pole 20 may be folded or bent through 180 degrees, at its midsection as shown in FIG. 2, with its two ends brought substantially parallel to one another so that it is reduced to one-half its length. Accordingly, transport is not nearly so awkward or difficult in many situations as would be the case if the pole 20 could not be folded to half its length.

With continued reference to FIGS. 1 and 2, the doll pole 20 comprises an elongate, hollow tube 24 closed at its lower end by a bottom panel 26. A metal D-ring 28 is attached to the upper end of the tube 24 by a hanging strap 30. Stuffed dolls 32 are removably suspended from the pole 20 by plural ribbons 34 secured at their midpoints to the pole 20 and adapted to be tied around the dolls 32.

Figure 9:
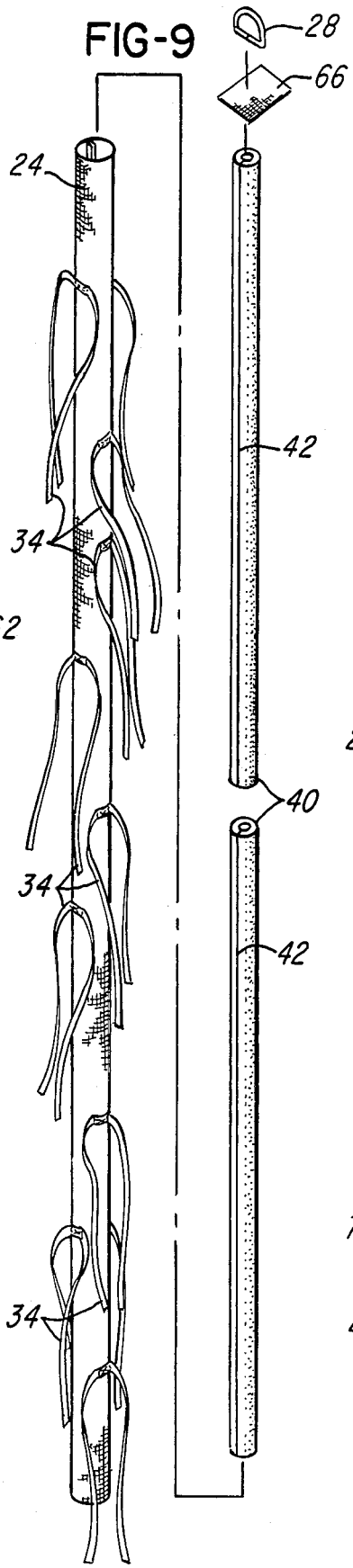
FIG. 9 is an exploded perspective view of parts of the pole of FIG. 1.

With reference to FIG. 9, the hollow tube 24 is substantially filled by pole stiffening and filler means comprising a pair of mutually identical, elongate, cylindrical, resilient, hollow, closed cell foam plastic filler rods 40. Rods 40 are slidably supported in the tube 24 and each has a length equal to slightly less than one-half the length of the tube 24. These may inexpensively comprise three foot sections of hollow polyethelene foam plastic which are commercially available for use as pipe insulators. Rods such as the rods 40 are commonly provided with longitudinally extending, partly formed slits 42. The purpose of the partly formed slits 42, which is unrelated to the instant invention, is believed to be for enabling the margins of the slits 42 to be spread apart for ease of assembly of the rods over sections of water pipe or the like. (Due to the frangibility of the foam plastic forming the rods 40, the partly formed slits are easily converted to full slits.) The slits 42 are not needed for the practice of the instant invention but are an advantage if there is a snug fit between the rods 40 and the tube 24 which renders it difficult to slide the rods 40 into the tube 24. In such event, one margin of the slit 42 of each rod can be partly coiled under the other margin of the same slit 42, thereby changing the shape of the rods 40 to render it easier to slide them into the tube 24. After such insertion, the rods 40 may easily be manipulated to return them to their full diameter and cylindrical shape with the margins of the longitudinal slits 42 brought back into mutually confronting relation.

The rods 40 are commercially available in approximately three-foot lengths and the tube 24 is preferably about six feet four inches long. With this construction, the pole 20 may be folded over at its midsection as shown in FIG. 2 for storage and transport, one rod 40 being at the lower end of the tube 24 and the other rod sliding to the upper end of the tube 24. When unfolded, the rods 40 are coaxially aligned and, when the pole 20 is suspended, the upper rod is supported by the lower rod 40 and the pole 20 will hang straight as shown in FIG. 1.

FIGS. 3 through 12 illustrate how the pole 20 is constructed. The tube 24 is formed from an elongate strip 50 of flexible sheet material that is illustrated as a conventional woven fabric. It is to be understood, of course, that various other flexible sheet materials, such as plastic sheeting or leather, may be used. Given the preferred overall dimensions discussed above, the sheet 50 would be approximately 78" long by 7" wide.

Figure 4:
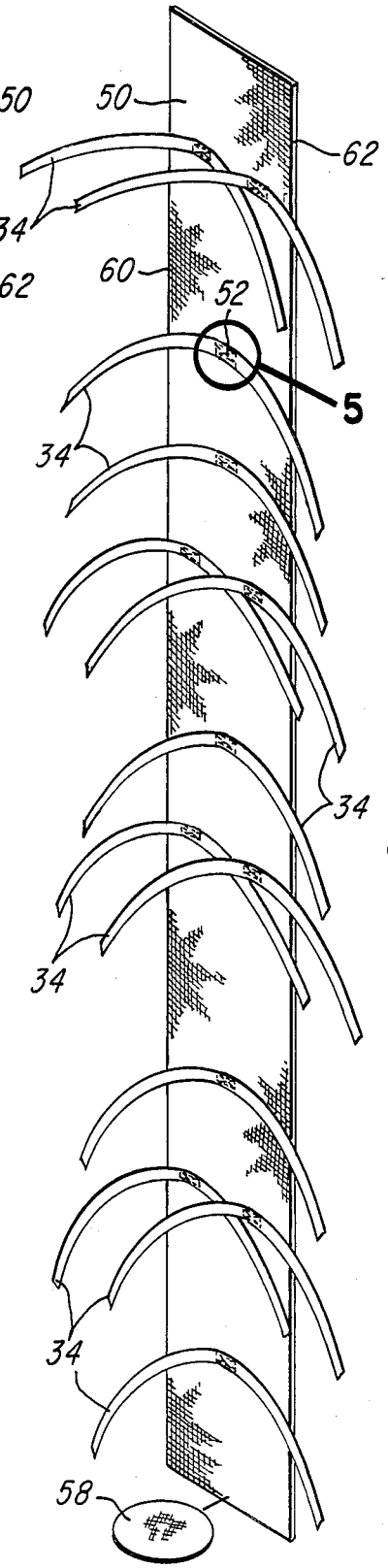
FIG. 4 is a perspective view showing parts used to produce the pole of FIG. 1 and initial steps taken to manufacture the same.
Figure 5:
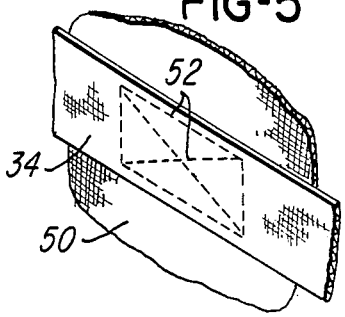
FIG. 5 is an enlarged fragmentary perspective view of the portion within circle 5 of FIG. 4.
Figure 6:
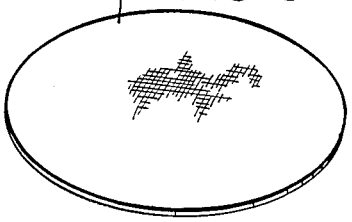
FIG. 6 is an enlarged perspective view of a part of the pole.

With reference to FIGS. 4 and 5, the ribbons 34 are securely affixed to the strip 50 in the desired pattern. Although other means may be used, the ribbons 34 are shown sewn along stitch lines 52 to the strip 50. The ribbons 34 may comprise two-foot long strips of woven polyester ribbon.

Figure 7:
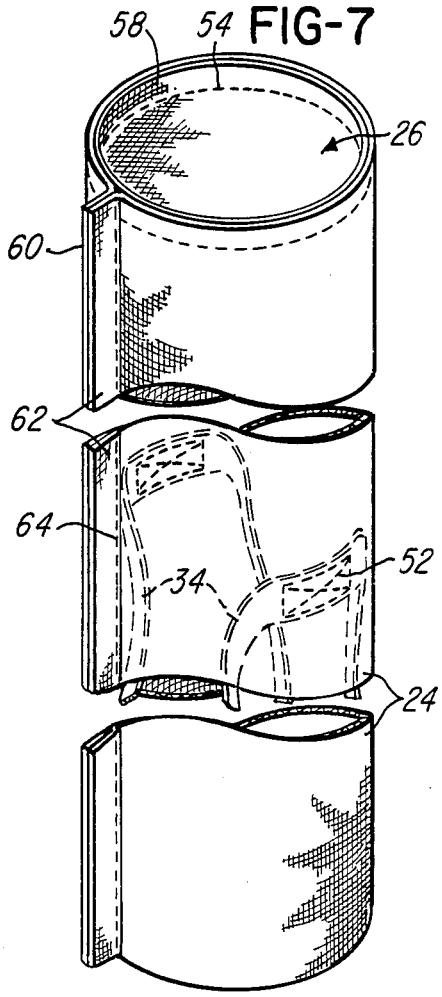
FIGS. 7 and 8 are fragmentary perspective views showing parts of the pole of FIG. 1 and further steps taken to manufacture the same.
Figure 8:
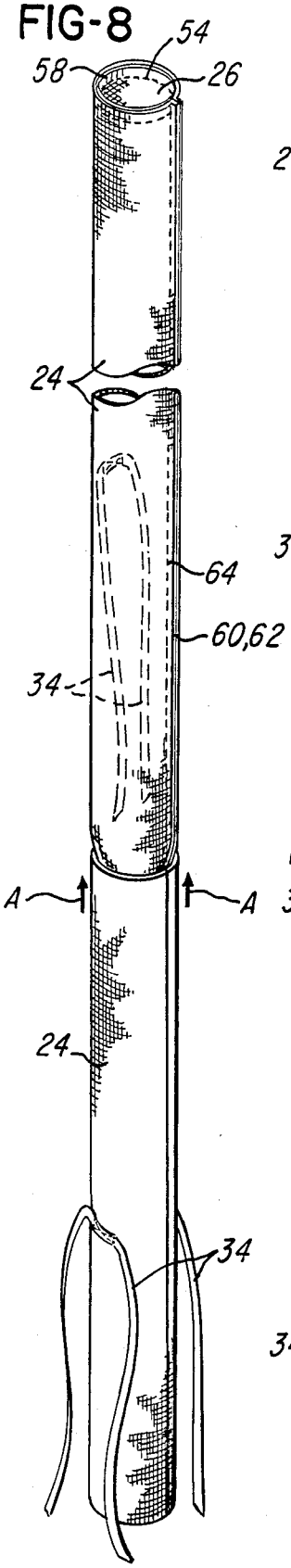

After the ribbons 34 are secured, the hollow tube 24 is formed inside out by first affixing, as by sewing along a circular stitch line 54, one of the ends of the strip 50 to a circular disc 58 (FIGS. 4, 6 and 7) that forms the bottom panel 26 and then by securing together the opposite longitudinal edges 60 and 62 of the strip 50 along its entire length as shown in FIG. 7, as by a longitudinally extending stitch line 64. The tube 24 is then turned rightside-out from end-to-end as indicated by the arrows A in FIG. 8, so that the margins 60 and 62 are hidden and protected within the tube 24. The stiffening and filler rods 40 may then be inserted therein. As is apparent, the diameter of the rods 40 is just slightly less than the diameter of the tube 24 so that they may be slid therein.

Figure 10:
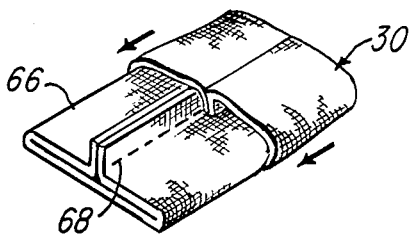
FIGS. 10 through 12 are enlarged fragmentary perspective views, FIG 11 also being exploded, showing parts of the pole of FIG. 1 and still further steps taken to manufacture the same.
Figure 11:
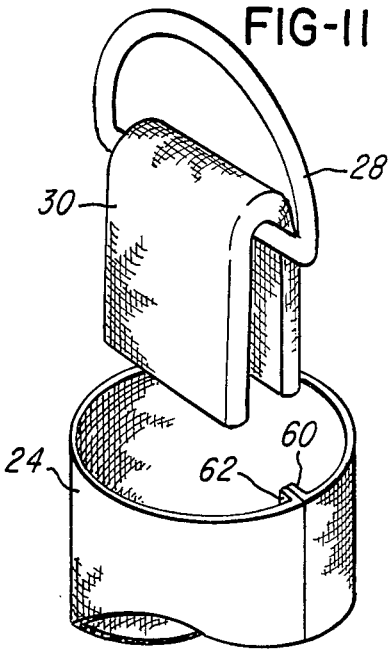
Figure 12:
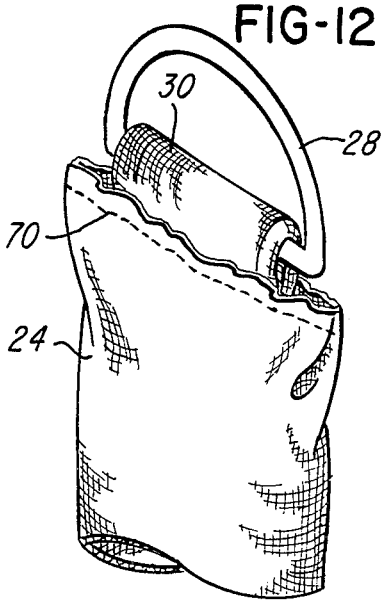

With reference to FIGS. 9 through 12, the hanging strap 30 may be formed from a single strip 66 of the same material that forms the strip 50, the opposite edges of which are secured together by stitching 68 as shown in FIG. 10. This, too, is turned inside-out to hide and protect the margins of the strip 66. The hanging strap 30 is then draped over the D-ring 28 as shown in FIG. 11, and its ends inserted into the upper end of the hollow tube 24. The final step in assembly of the pole 200 is shown in FIG. 12 in which the hanging strap 30 is secured to the upper end of the hollow tube 24, preferably by stitching as shown at 70, which also closes the upper end of the hollow tube 24 and secures the D-ring 28 thereto.

It will be noted that the objects of this invention have been met in a simple yet effective manner. The sheet material forming the hollow tube 24 may be printed or otherwise formed with colored patterns which can add to the overall attractiveness of the pole when in use. The same fabric, such as a cotton and polyester blend may be used to form the tube 24, the end panel 26, and the hanging strap 30. Since the pole 20 is easily and inexpensively manufactured, it may readily be assembled by hand or with the use of high speed machinery.

Although the presently preferred embodiment of this invention has been disclosed, it will be apparent that various changes may be made within the purview of the following claims.

We claim:

1. A doll pole comprising:

an elongated, hollow tube formed from flexible sheet material;

means covering the bottom end of said tube;

means connected to the upper end of said tube for suspending said tube from a wall or ceiling;

plural holding means connected to said tube and spaced along the length thereof for removably suspending stuffed animal dolls or the like from said tube; and stiffening and filler means within and substantially filling said tube for causing said tube to have an elongated, pole-like shape and for maintaining said shape during use, said stiffening and filler means comprising plural rods slidably mounted within said tube and coaxially aligned therein, said rods having a combined length sufficiently less than the length of said tube that said tube may be folded through substantially 180 degrees at its midsection for storage and shipment.

2. The pole of claim 1 wherein said rods comprise a foam plastic.

3. The pole of claim 1 wherein said rods comprise a resilient foam plastic.

4. The pole of claim 1 wherein said holding means comprise elongate flexible ribbons connected at their midsections to said tube.

5. The pole of claim 1 wherein said flexible sheet materials comprises a woven fabric.

6. The pole of claim 5 wherein said holding means comprise elongate flexible ribbons connected at their midsections to said tube.

7. The pole of claim 6 wherein each of said ribbons comprises a woven fabric.

8. The pole of claim 1 wherein said means connected to the upper end of said tube for suspending said tube comprises a hanging strap secured to the upper end of said tube.

9. The pole of claim 8 wherein said means connected to the upper end of said tube for suspending said tube further comprises a metal ring connected to said tube by said hanging strap.

10. The pole of claim 1 wherein said means covering said bottom end comprises a woven fabric sheet sewn to the lower end of said tube.

11. The pole of claim 10 wherein said means connected to the upper end of said tube for suspending said tube comprises a hanging strap made from a woven fabric sewn to the upper end of said tube.

12. The pole of claim 11 wherein said means connected to the upper end of said tube for suspending said tube further comprises a metal ring connected to said tube by said hanging strap.

13. The pole of claim 1 wherein said plural rods comprise a pair of substantially identical rods.

14. The pole of claim 13 wherein said rods comprise a foam plastic.

15. The pole of claim 13 wherein said rods comprise a resilient foam plastic.

16. The pole of claim 13 wherein said holding means comprise elongate flexible ribbons connected at their midsections to said tube.

17. The pole of claim 13 wherein said flexible sheet means comprises a woven fabric.

18. The pole of claim 17 wherein said holding means comprise elongate flexible ribbons connected at their midsections to said tube.

19. The pole of claim 18 wherein each of said ribbons comprises a woven fabric.

20. The pole of claim 13 wherein said means connected to the upper end of said tube for suspending said tube comprises a hanging strap secured to the upper end of said tube.

21. The pole of claim 20 wherein said means connected to the upper end of said tube for suspending said tube further comprises a metal ring connected to said tube by said hanging strap.

22. The pole of claim 21 wherein said means covering said lower end comprises a woven fabric sheet sewn to the lower end of said tube.

23. The pole of claim 22 wherein said means connected to the upper end of said tube for suspending said tube comprises a hanging strap made from a woven fabric sewn to the upper end of said tube.

24. The pole of claim 23 wherein said means connected to the upper end of said tube for suspending said tube further comprises a metal ring connected to said tube by said hanging strap.

* * * * *